United States Patent [19]

Henmi et al.

[11] Patent Number: 4,614,334

[45] Date of Patent: Sep. 30, 1986

[54] SHEET INSERTING GUIDE

[75] Inventors: Kojiro Henmi; Eiji Miyasaka, both of Hikone, Japan

[73] Assignee: Dainippon Screen Manufacturing Co., Ltd., Kyoto, Japan

[21] Appl. No.: 668,348

[22] Filed: Nov. 5, 1984

[30] Foreign Application Priority Data

Feb. 8, 1984 [JP] Japan ..... 59-17007[U]

[51] Int. Cl.[4] ..... B65H 5/38

[52] U.S. Cl. ..... 271/8.1; 271/264

[58] Field of Search ..... 271/8.1, 19, 34, 264, 271/272, 273, 274, 900

[56] References Cited

U.S. PATENT DOCUMENTS 1,357,644 11/1920 Leonard ..... 271/8.1

3,031,187 4/1962 Sano et al. ..... 271/19

3,963,339 6/1976 Taylor et al. ..... 271/34

*Primary Examiner*—Bruce H. Stoner, Jr.

*Assistant Examiner*—Lawrence J. Goffney, Jr.

*Attorney, Agent, or Firm*—Millen & White

[57] ABSTRACT

A sheet inserting guide for engaging a flexible sheet material with sheet transfer device comprising a base plate, and a restriction plate spaced from the base plate to define a sheet insertion port therebetween at an end adjacent said sheet transfer device. The restriction plate defines at least an inwardly tapered side edge at the other end thereof away from said sheet transfer device, the portion of said restriction plate defining said tapered side edge preferably being bent outwardly at an angle relative to said base plate.

1 Claim, 7 Drawing Figures

SHEET INSERTING GUIDE

BACKGROUND OF THE INVENTION

This invention relates to a device for transferring flexible sheet-like materials (hereinafter referred to as sheet materials) such as photosensitive films, paper, and plastic films. More particularly it relates to a guide for smoothly inserting sheet materials into a slit-like insertion port.

In a device for transferring sheet materials using belt transfer means or roller transfer means such as for use in a process camera equipped with an automatic rolled photosensitive film feeder, electrostatic copying machine, automatic developing machine, or flexible printed circuit board producing device, a guide 1 shown in FIG. 5 has heretofore been used. Such guide 1 is formed with a slit-like insertion port 5 for introducing a fed-in sheet material 2 into transfer means 3 and is provided with sloped section 7 with the spacing between it and an insertion base 6 being gradually narrowed toward the insertion port 5 in the upstream side of the latter so that the sheet material 2, even if having warp resulting from its being rolled, may not be folded or cause a jam. This guide 1, as shown in FIG. 5, is associated with restriction bars 4 which cover opposite lateral ends of the sheet material 2 to ensure that it enters the guide 1. However, as shown in FIG. 6, if the spacing between the restriction bars 4 is less than the width of the sheet material 2 at its leading end to thereby enable only a middle portion of the leading end of the sheet material 2 to enter the guide 1, such sheet material would be folded at its front end corners in triangular form or cause a jam. For example, a slit exposure camera 10 as shown in FIG. 7 is designed to place a sheet material 2 such as a sensitive film on a transparent plate 11, to lower a pair of pressing members 12 to contact the sheet material 2 with the transparent plate 11 during exposure, to lift the pair of pressing members 12 upon completion of exposure, and to cause suction transfer means 13 to suck the portion of the sheet material 2 extending beyond the pair of pressing members 12 so as to transfer it to discharge rollers 14. In such camera 10, the pair of pressing members 12 function as said restriction bar 4 during discharge of the sheet material 2. Since a space or room must be kept aside on each lateral side edge of the sheet material 2 for sucking the sheet material 2 by the suction transfer means 13, the pair of pressing member 12 or restriction bars 4 cannot be disposed with a spacing to cover the entire width of the sheet material 2 as viewed in the direction of transfer. It often occurs that, as in the slit exposure camera 10 shown by way of example in FIG. 7, because of various factors such as the construction and space factors, the sheet material 2, having only a portion of its leading end pressed, is transferred into the slit-like insertion port 5 as by roller transfer means. In this case, with the conventional guide, the sheet material 2 is folded or cause a jam.

In addition, in FIG. 7, the numeral 21 denotes an original mount; 22 denotes a film; 23 denotes a triangular mirror; 24 denotes a lens; and 25 denotes a mirror.

An object of the present invention is to provide a guide which eliminates such inconveniences, wherein when the sheet material is transferred into the slit-like insertion port, even if it is not introduced into the guide throughout its width at it leading end, the guide prevents the sheet material from being folded or causing a jam.

BRIEF SUMMARY OF THE INVENTION

In accordance with this invention, there is provided a sheet inserting guide for engaging a flexible sheet material with sheet transfer means. Said guide comprises a base plate and a restriction plate spaced from the base plate to define a sheet insertion port therebetween at an end adjacent said sheet transfer means. The invention is characterized in that said restriction plate defines at least an inwardly tapered side edge at the other end thereof away from said sheet transfer means. Preferably, the portion of said restriction plate defining said tapered side edge is bent outwardly at an angle relative to said base plate.

DETAILED DESCRIPTION OF THE INVENTION

Figure 1:
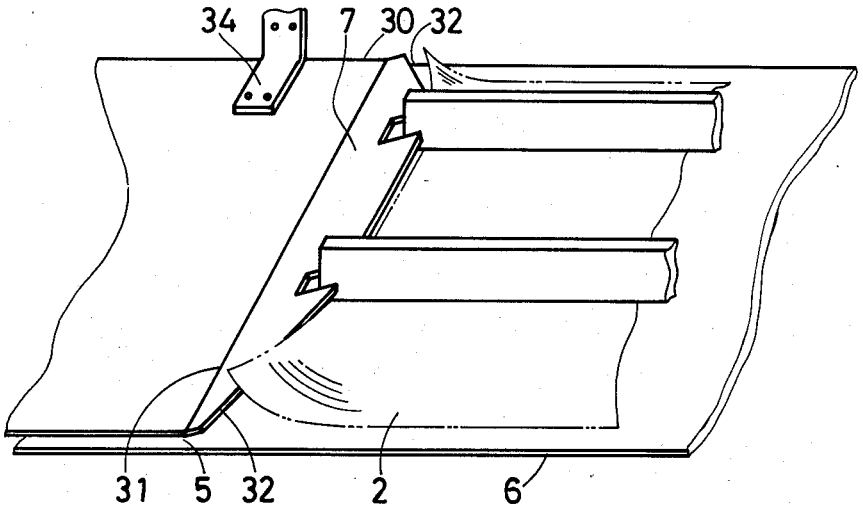
FIG. 1 is a perspective view of a sheet inserting guide constructed in accordance with a first embodiment of the invention.

In the embodiment shown in FIG. 1, a sheet inserting guide include a base plate 6 forming a sheet transfer path and an upper guide plate 30 spaced from the base plate 6 to define a sheet insertion port 5. The upper guide plate 30 defines a pair of inwardly tapered side edges 32 at its inlet end for receiving a sheet material 2. The portion 7 of said upper guide plate 30 defining the pair of inwardly tapered side edges 32 is bent upwardly along a line 31 at an angle relative to the remainder of the plate 30 and also relative to the base plate 6.

Figure 2:
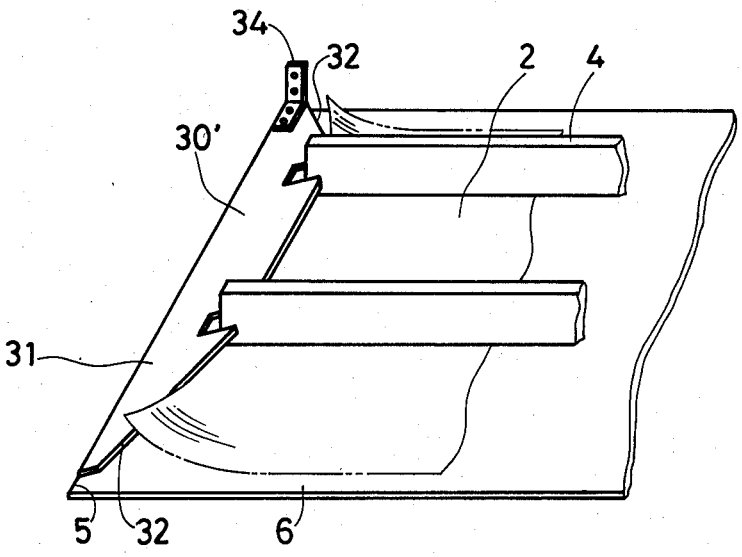
FIG. 2 is a perspective view of a guide according to a second embodiment of the invention.
Figure 5:
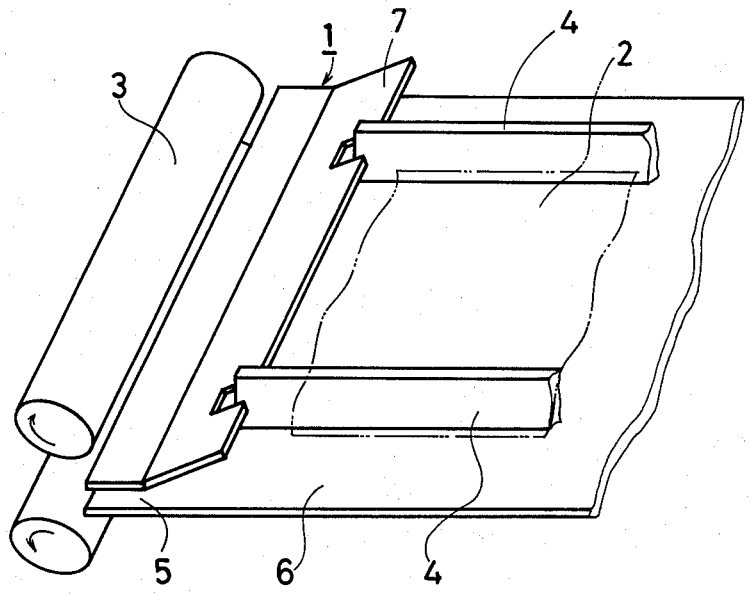
FIG. 5 PRIOR ART
FIG. 5 and FIG. 6 are perspective views of a prior art sheet inserting guide illustrating how difficulties would occur with the conventional guide.
Figure 6:
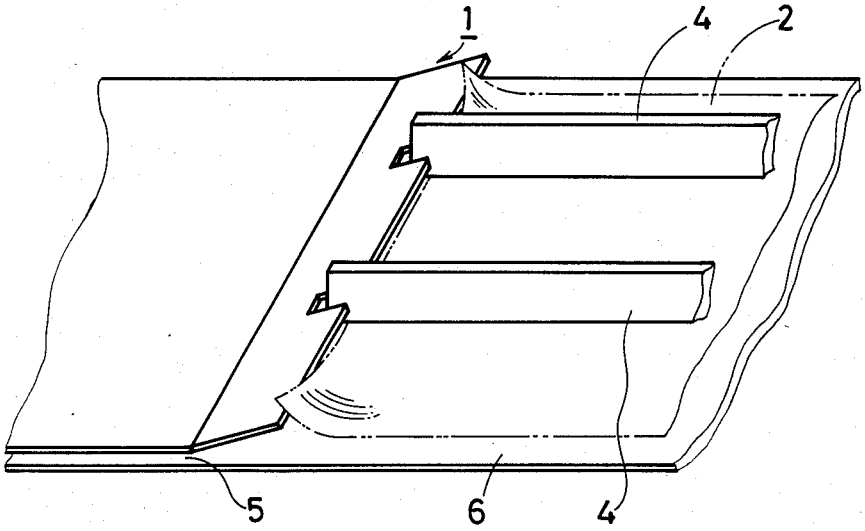
FIG. 6 PRIOR ART
Figure 7:
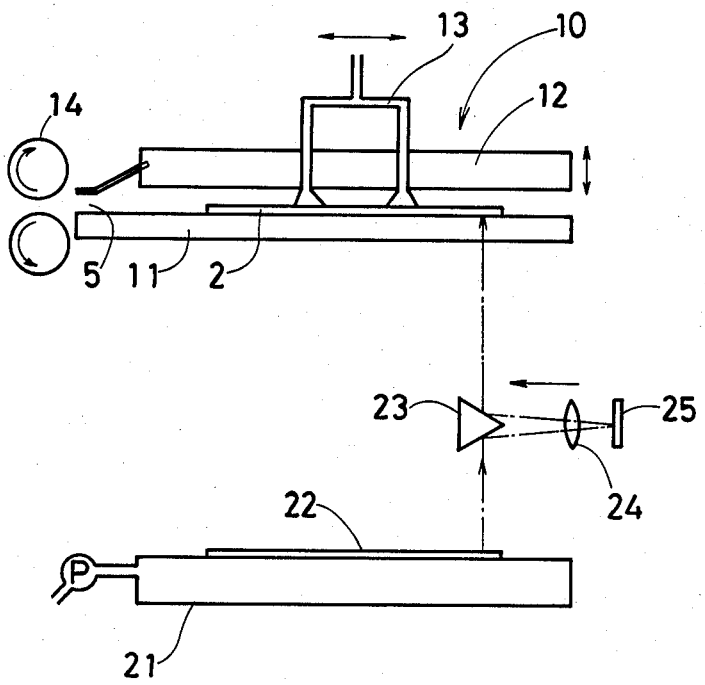
FIG. 7 PRIOR ART
FIG. 7 is a schematic illustration of a slit exposure camera associated with the prior art sheet inserting guide.

Such guide plate 30 shown in FIG. 1 is formed, e.g., of a chromium-plated iron sheet about 1–2 mm thick, has a pair of inwardly tapered edges 32 formed by obliquely cutting its portions outside a pair of restriction bars 4, and is inclined upwardly by being bent along an intermediate line 31 so that the spacing between the plate portion 7 and the insertion base 6 is decreased as viewed in the transfer direction. The aforesaid chromium plating is intended to reduce the frictional resistance between the sheet material 2 and the guide plate 30 so as to facilitate slide movement. A fluorocarbon coating or the like is also effective for this purpose, but such surface treatment is not absolutely necessary. When corners of such iron sheet are obliquely cut, the cut edges must be processed smooth. The numeral 34 denotes a support member. In the case of FIG. 2, if the transfer means 3 (FIG. 5) is positioned close to the guide plate 30, the latter does not need to be bent and may be as cut off.

Figure 3:
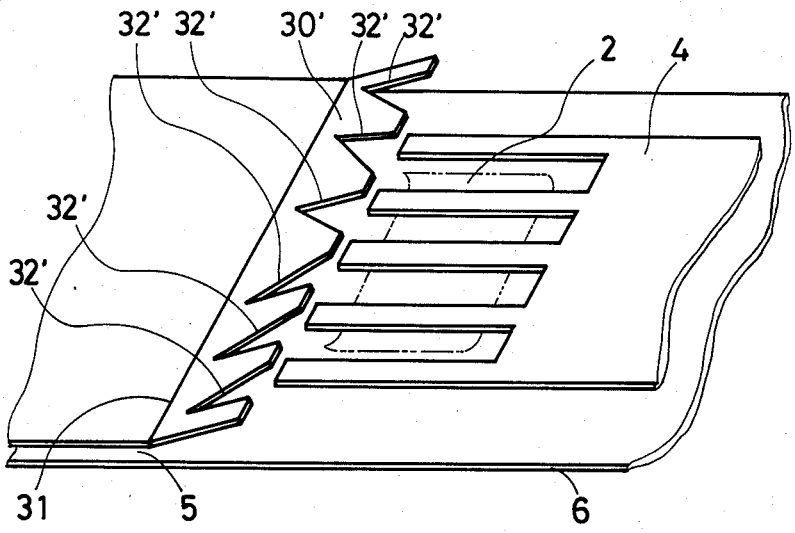
FIG. 3 and FIG. 4 are similar views to FIG. 1 of further embodiments of the invention.

A guide 30' shown in FIG. 3 is another embodiment, wherein it is formed with a plurality of pairs of tapered side edges 32' so as to transfer various sizes of sheet material 2, and they are formed at such positions that any size of sheet material 2 may have its curled portions contacted with the corresponding tapered side edges 32'.

Figure 4:
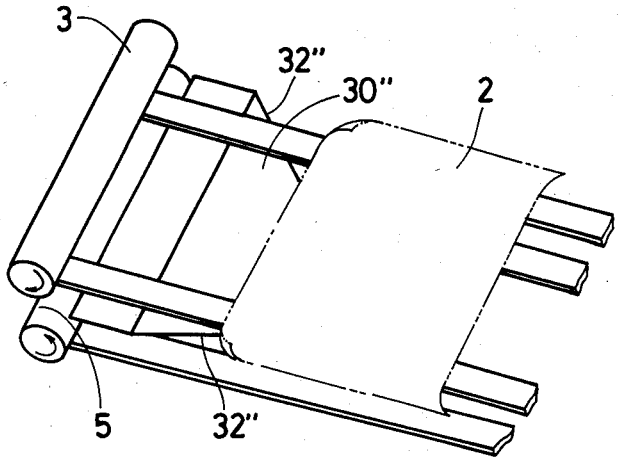

FIG. 4 shows a further embodiment, wherein a guide plate 30'' is adapted to handle a sheet material 2 supported with its opposite ends warping downwardly. The guide plate 30'' is positioned below the sheet material 2.

In the above embodiments, the guide according to the present invention may be made of nickel-plated or chromium-plated iron sheet or other sheet metals, plastics or any other material whose slide resistance to the sheet material is low. As for the number of tapered side edges 32, one is provided where only one corner of the sheet material has warp due to the rolling of the sheet material, while two tapered edges are provided where two corners on opposite sides of the sheets have warp, so that various sizes of sheet material can be handled. Thus, the number is not restricted. As for the angle of inclination of the tapered side edges 32, while 45° C. has been empirically found suitable in many cases, it may be suitably changed according to such conditions as the stiffness of the sheet material, the transfer speed, and the amount of warp resulting from the sheet material being rolled. The tapered side edges may be straight, slightly bulged, or otherwise suitably shaped. Further, the guide according to the present invention is applicable to sensitive films, original paper and other plastic films, paper material, and any other material in sheet form. In addition, the transfer means for inserting the sheet material by using the guide of the present invention may be roller transfer means, belt transfer means, or other transfer means, e.g., manual transfer. The guide is applicable not only to insertion into transfer means but also to insertion of a sheet material into some slit-like opening.

Further, the tapered sides edges 32 may be formed by bending the required portions rather than by cutting.

We claim:

1. A sheet inserting guide for engaging a flexible sheet material with sheet transfer means comprising:

a base plate;

a restriction plate positioned above the base plate to define a sheet insertion port between the base plate and restriction plate at an end adjacent to the sheet transfer means, said plate having a portion defining at least a pair of inwardly tapered side edges bent outwardly at an angle relative to the base plate with the remainder of the restriction plate extending parallel to the base plate, a plurality of pairs of the tapered side edges being positioned symmetrically at the end of the restriction plate oriented away from the sheet insertion port.

* * * * *